US005660272A

United States Patent [19]

Janniere et al.

[11] Patent Number: 5,660,272

[45] Date of Patent: Aug. 26, 1997

[54] LATERALLY ACTUATED ELECTRICAL SWITCH

[75] Inventors: Alain Janniere, Paris; Laurent Bouvier, Dole, both of France

[73] Assignee: ITT Compasants Et Instruments, Bagneux, France

[21] Appl. No.: 647,542

[22] Filed: May 15, 1996

[30] Foreign Application Priority Data

May 16, 1995 [FR] France ..... 95 05754

[51] Int. Cl.[6] ..... H01H 1/10

[52] U.S. Cl. ..... 200/517; 200/533; 200/551

[58] Field of Search ..... 200/517, 537, 200/542, 529, 533, 535, 547, 551, 512, 284, 246, 275

[56] References Cited

U.S. PATENT DOCUMENTS

| | | | |
|---|---|---|---|
| 4,153,829 | 5/1979 | Murata | 200/533 |
| 4,771,139 | 9/1988 | De Smet | 200/512 |
| 4,803,321 | 2/1989 | Lefebvre | 200/517 |
| 4,851,625 | 7/1989 | Liebich | 200/551 |
| 5,564,560 | 10/1996 | Minelli et al. | 200/512 |

FOREIGN PATENT DOCUMENTS

| | | |
|---|---|---|
| 0131304 | 7/1984 | European Pat. Off. . |
| 3627695 | 8/1986 | Germany . |
| 2195616 | 1/1989 | Japan . |

*Primary Examiner*—David J. Walczak
*Attorney, Agent, or Firm*—Freilich Hornbaker Rosen

[57] ABSTRACT

A miniature electrical switch, of the type that includes a snap dome or tripping member (36) lying over a pair of contacts (30, 34), includes a small and effective actuator arrangement (41). The actuator arrangement includes a sheet metal force transfer member (43) with a horizontal plate (46) and with a deflectable strip or lever (48), and an actuator device or pusher (44) with a ramp (96) that can engage the lever to deflect it. Horizontal forward (F) movement of the pusher deflects the front of the lever downwardly, to depress the middle portion (40) of the tripping member.

11 Claims, 3 Drawing Sheets

FIG. 2
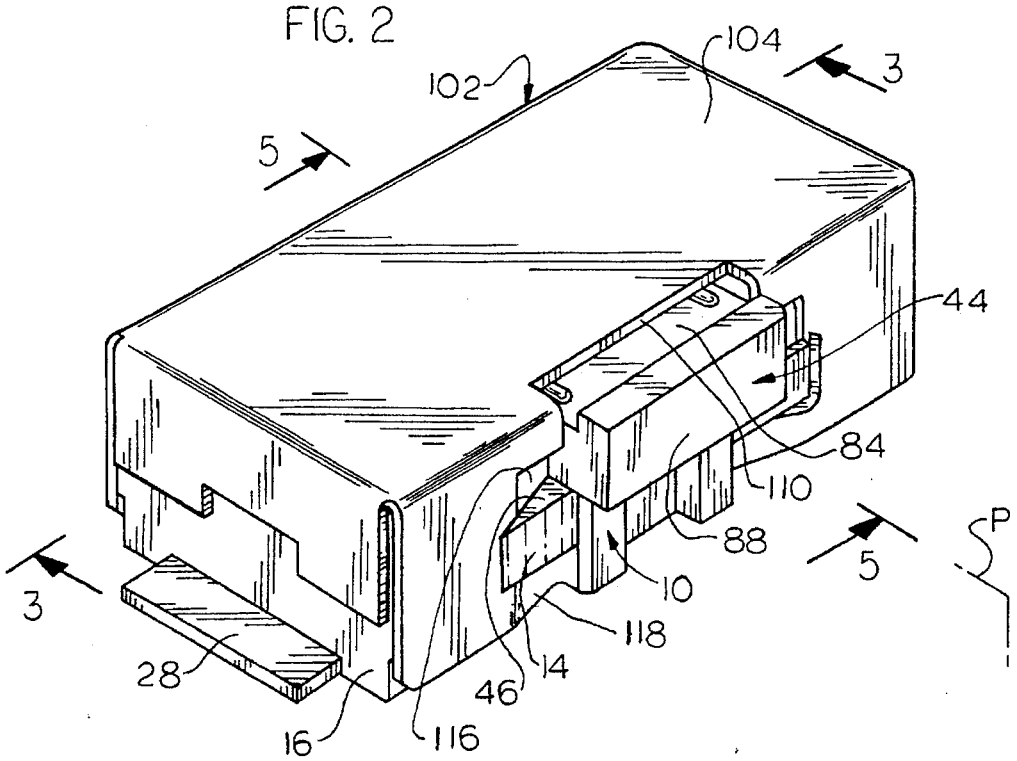
FIG. 3
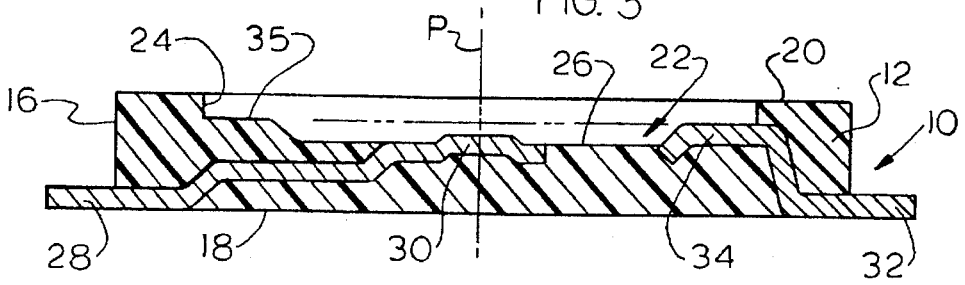
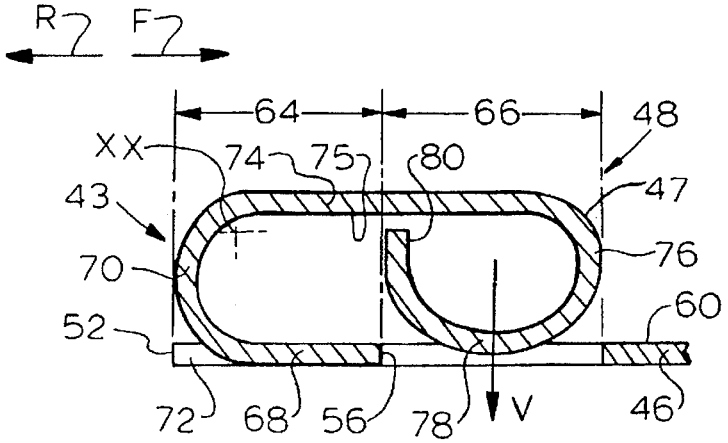
FIG. 4

LATERALLY ACTUATED ELECTRICAL SWITCH

BACKGROUND OF THE INVENTION

One type of miniature switch includes a tripping member, or snap dome, having a periphery engaging an outer contact, and a middle lying over an inner contact. As the middle is depressed, it reaches a state wherein it snaps down and engages the inner contact, to thereby connect the inner and outer contacts. The snap action creates a "click" sound and tactile feedback, which indicates that the switch has been closed.

An example of such switch with a tripping member is shown in document JP-A-02,195,616, which includes an articulated part of a pusher which is coupled to a ramp formed by a cutout in the upper wall of a switch cover. The cutout in the cover prevents easy gripping of the switch by a mechanical arm during assembly, especially during surface mount on a printed circuit board. Also, in the above prior art document, an articulated part of the pusher is connected to the body of the pusher by a thin portion forming a hinge, which is difficult to form and which requires precise pusher guidance. A small switch of the type that includes a tripping member, which had an easily constructed but reliable actuator arrangement, where the actuator arrangement did not interfere with machine pickup of the switch, as by suction applied to its upper wall, would be of value.

SUMMARY OF THE INVENTION

In accordance with one embodiment of the present invention, a small electrical switch is provided which is easily handled, and of low cost but reliable construction. The switch is of the type that includes a snap dome or tripping member lying over a pair of contacts, and an actuator arrangement for depressing the middle of the tripping member. The actuator arrangement includes a piece of resilient sheet metal having a mount portion substantially fixed with respect to the switch housing, and a strip-shaped lever with a depressing part which lies adjacent to the middle of the tripping member. At least part of the lever is resiliently bendable to allow the depressing part to move down against the middle tripping portion. The actuator arrangement also includes an actuator device or pusher that is movable against the lever to deflect it downwardly so its depressing part moves down the middle tripping portion, and so the resilient lever biases the pusher back toward a rest state.

The piece of sheet metal can include a horizontal plate trapped in the housing, with the lever having a rear loop extending upwardly from the plate and a forward loop extending downwardly, with the depressing part lying along the forward loop. The pusher has an inclined surface or ramp, which moves against the front loop as the pusher moves rearwardly, causing bending of the rear loop so the forward loop and the depressing part thereon moves down.

The pivot axis of the lever extends horizontally and perpendicular to the horizontal sliding direction of the pusher. The pusher slides on the upper face of the sheet metal plate. The plate includes upstanding guide tabs that guide the pusher and an upstanding stop tab that limits movement of the pusher. The switch housing includes a cover with a continuous upper wall for suction pickup. The cover has a front with a cutout in which the pusher moves.

The novel features of the invention are set forth with particularity in the appended claims. The invention will be best understood from the following description when read in conjunction with the accompanying drawings.

BRIEF DESCRIPTION OF THE DRAWINGS

FIG. 2 is an isometric view of the fully assembled switch of FIG. 1.

FIG. 3 is a view taken on line 3—3, of the contact-carrying lower housing portion of the switch of FIG. 2.

FIG. 4 is a view taken on the midplane P of FIG. 2, showing a portion of the sheet metal force transmitting member of the switch.

DESCRIPTION OF THE PREFERRED EMBODIMENT

Figure 1:
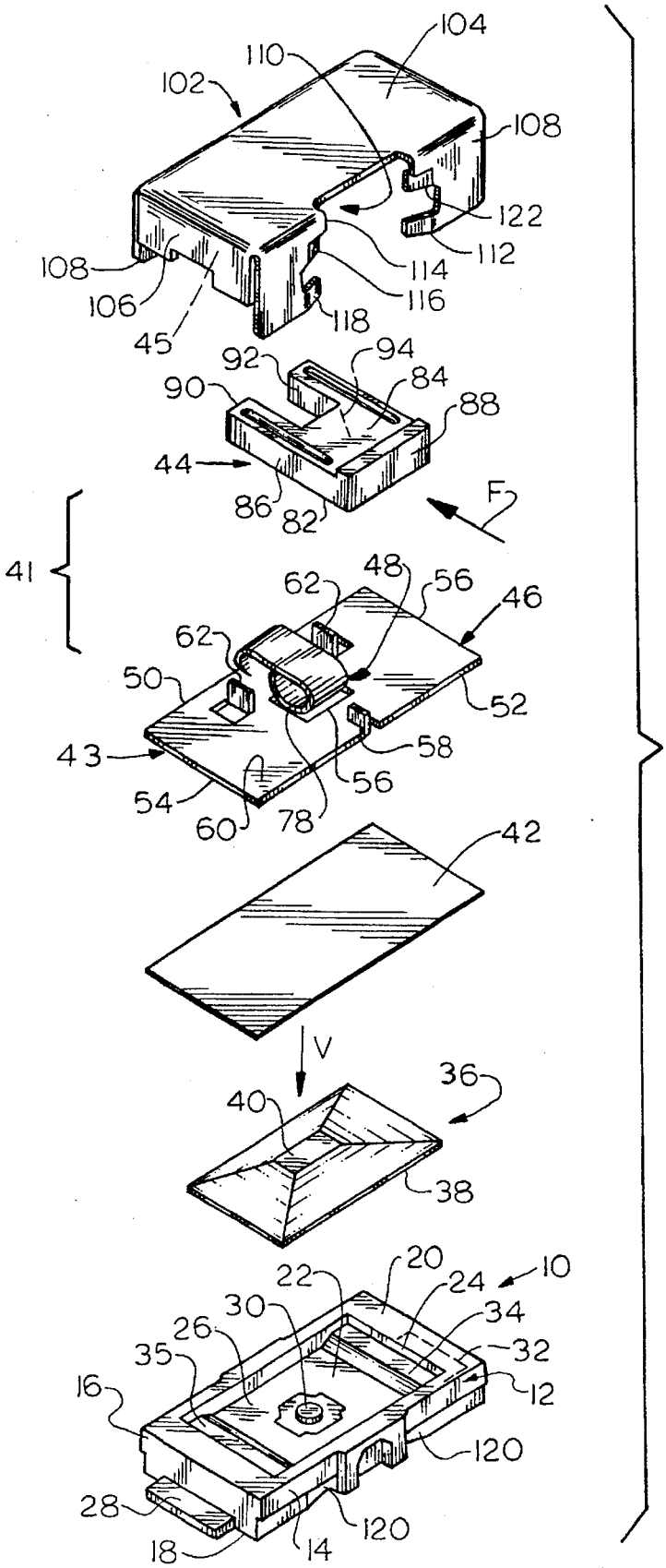
FIG. 1 is an exploded isometric view of an electrical switch of the present invention.

FIG. 1 illustrates a switch of the present invention, which includes a housing 10 comprising lower and upper housing portions 12, 102. The lower housing portion 12 has an upwardly-opening recess 22 with a bottom 26 and peripheral or side walls 24. An inner contact 30 lies near the middle of the recess, while an outer contact 34 lies closer to the periphery of the recess. A tripping member 36 has a peripheral tripping portion 38 which fits in the recess and engages the outer contact 34. The tripping member also has a middle tripping portion 40 which lies generally in the recess, over the inner contact 30. When the middle tripping portion 40 is depressed more than a predetermined amount, it suddenly "snaps" down to engage the inner contact 30, and thereby connect the two contacts 30, 34. Such snap domes or tripping members are well known in the prior art for use in small switches.

Downward force for depressing the middle tripping portion 40 is applied by an actuator arrangement 41, which includes a pusher or actuator device 44 that can be pushed in the forward direction F, and a force transmitting member 43 which converts forward horizontal movement of the pusher 44 into downward movement of the middle tripper portion 40 of the tripping member. A sealing film 42 lies on an upper face 20 of the lower housing portion 12, to seal the region within the recess 22. Such sealing avoids corrosion of the contacts 30, 34 and of the lower surface of the tripping member 36, to assure reliable switching. The sealing film 42 is very flexible, so its middle can be readily depressed to snap down the tripping member 36.

The force transfer member 43 is formed from a single piece of resilient sheet metal. It includes a mount portion 46 in the form of a plate, which rests (through the sealing film 42) on the upper face 20 of the lower housing part. The force transmitting member also includes a strip or lever 48 which can be readily bent, and which has a depressing part 78 that can depress the middle tripping part 40 (through the film 42) to close the switch. The lever 48 is depressed by forward movement of the pusher 44, when an inclined (to the vertical V) surface or ramp 94 of the pusher pushes down the strip. The pusher 44 slides on an upper face 60 of the plate mount portion 46, and is confined in travel within a central cutout 110 in the upper housing portion or cover 102. A horizontal upper wall 104 of the cover has a continuous upper surface, which facilitates handling of the switch during assembly, as with suction devices that engage the upper wall. The upper housing portion has a downwardly-opening recess 45 within which much of the pusher 44 moves.

FIG. 4 shows some details of the force transfer member 43 which includes the mount portion 46 that is fixed to the switch housing, and the strip-shaped lever 48 that can be deflected to move the depressing part 78 towards the tripping member. The lever 48 includes rear and front sections 64, 66, with most of the bending occurring at the rear section 64, and with most of the up and down movement occurring at the front section 66. The rear section includes an upwardly-extending inner or rear loop 70 where the strip is curved to extend up above the plate. The rear loop provides high resilience in bending. The front section includes an outer or front loop 76 which extends downwardly to the depressing part 78. A pair of short slits 72 begin the lever from a location 68. A connecting portion 74 with a lower face 75, extends between the rear and front loops.

Downward force is initially applied to the forward loop 76 at an upper-forward location 47 thereof, causing the depressing part 78 to move downwardly. Such downward movement results primarily in pivoting of the front section 66 and the depressing part 78, about an axis XX which is located at the upper portion of an area substantially within the rear loop 70, and with most of the bending occurring at the rear loop. It should be noted that the mount portion or plate 46 has an opening 56 through which the depressing part 78 moves down. The opening 56 is only slightly wider than the front loop 76, and can prevent sideward bending or skewing of the lever. The lever 48 includes an end 80 which can abut the connecting portion 74, to limit compression of the outer loop 76 as the outer loop is pressed downward. The pusher initially contacts the location 47, but the contact location progresses rearwardly as the lever is depressed.

Figure 5:
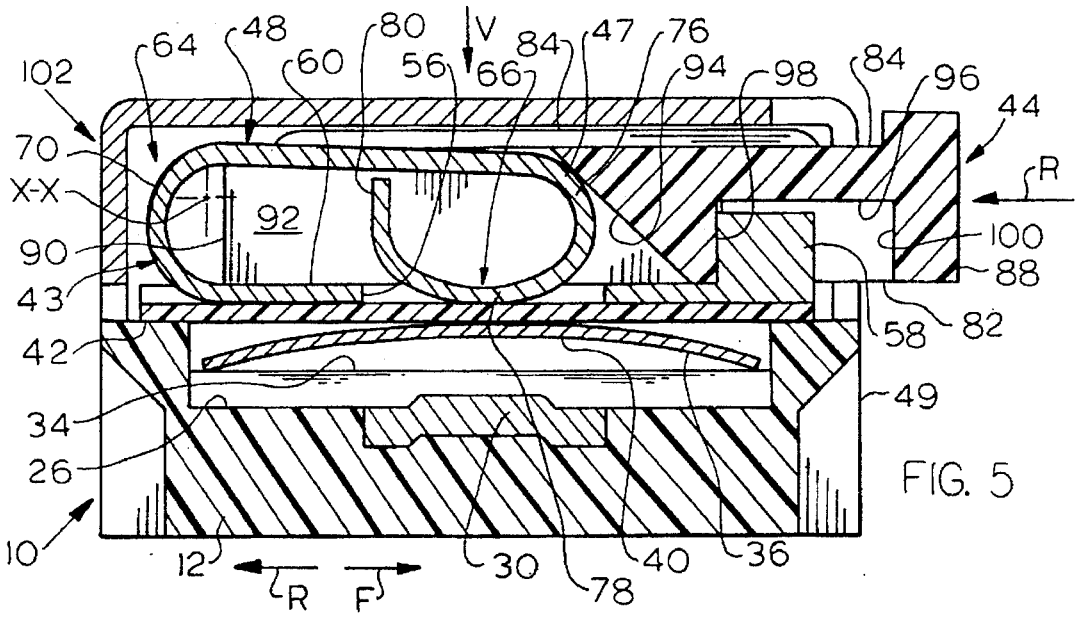
FIG. 5 is a view taken on line 5—5 of FIG. 2, illustrating the pusher in the rest position.
Figure 6:
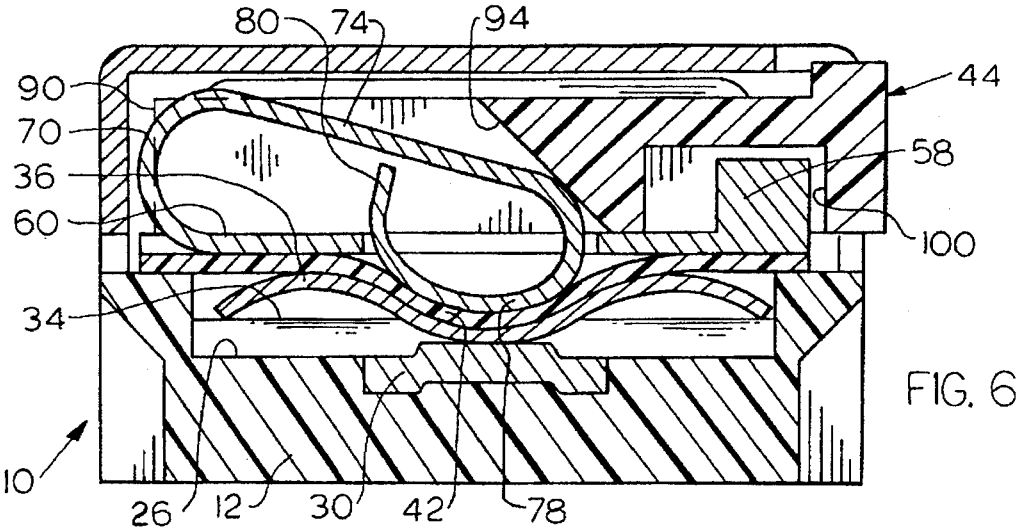
FIG. 6 is a view similar to that of FIG. 5, showing the switch in the tripping position.
Figure 7:
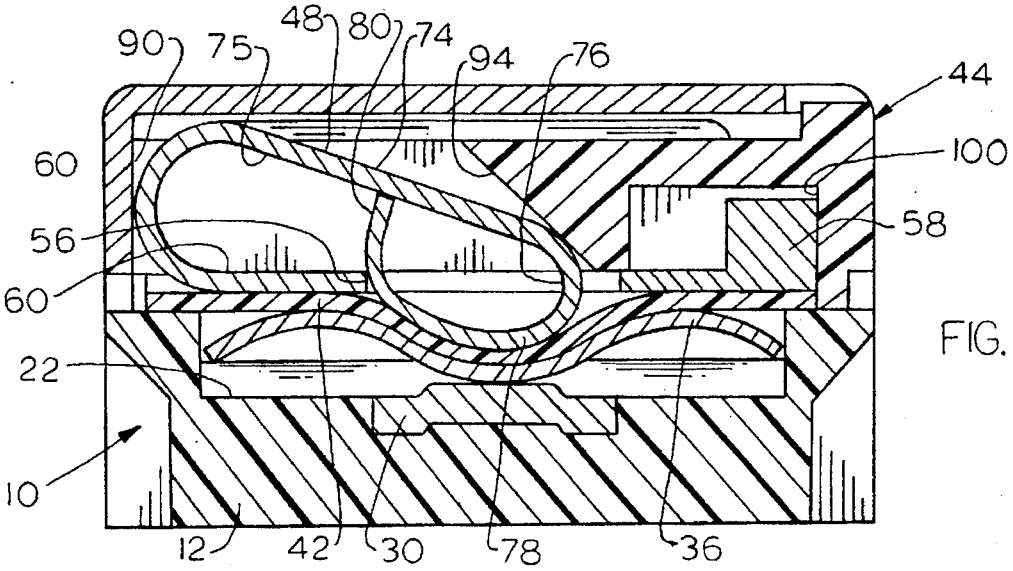
FIG. 7 is a view similar to that of FIG. 6, but showing the switch in an over traveled position.

FIGS. 5, 6, and 7 show the progress in operation of the switch. FIG. 5 shows the actuator device or pusher 44 in an initial or rest position, wherein its front face 88 projects appreciably from the front face 49 of the housing. When a force is applied in the rearward direction R to the front face 88 of the pusher, the inclined surface or ramp 94 presses against the forward loop 76, initially at the location 47. Both surface locations 94, 47 are inclined about 45° (preferably between 30° and 80°) from the vertical, and continued rearward movement of the pusher results in downward movement of the forward loop 76 and of the depressing part 78. Downward movement of the depressing part 78 is transmitted through the film 42 to the middle tripping part 40, to move the middle tripping portion towards the inner contact 30. The peripheral tripping portion continues to press firmly against the outer contact 34.

FIG. 6 shows the switch in a tripping position, wherein the depressing part 78 has depressed the middle tripping portion far enough that it has snapped down and engaged the inner contact 30. Such snap action is useful in indicating that the switch has been closed. Where the forward face 88 of the pusher has been pushed forwardly as by a card, this will create a sudden drop in resistance to slight forward card movement, resulting in a pulse to the card and to a person's finger that is pushing on the card. In any case, the snap action usually creates an audible "click" to indicate switch closing. It is possible to use a tripping member that does not snap down, but this is usually not desired. It can be seen that the rear loop 70 has moved slightly rearwardly while most of the bending has occurred at the rearward loop 70.

FIG. 7 shows the switch in an over traveled position, wherein the pusher 44 has continued to be pushed forward. The end 80 of the lever or strip 48 has engaged the connecting portion 74 to limit collapse of the forward loop 76. Further forward movement of the pusher is prevented by a stop tab 58. The presence of the upturned end 80, avoids the presence of a strip edge below the plate 60 which could damage the film 42.

FIG. 5 shows the stop tab 58 lying in a groove 96 formed in the pusher 44. The stop tab 58 can engage a rear groove wall 98 of the pusher to limit forward movement of the pusher. When the pusher is pushed fully rearwardly, a front groove wall 100 of the groove engages the stop to limit rearward movement. In all positions of the pusher, the resilient strip or lever 48 presses against the inclined surface 94 of the pusher to urge it forwardly. Thus, in the rest position of FIG. 5, the lever 48 has been deflected down slightly, and keeps the pusher 44 pressed against the stop tab 58, to prevent looseness or "rattling" of the pusher. In the tripping or over travel positions of FIGS. 6 and 7, the deflected lever urges the pusher forwardly, back to its rest position. Thus, the lever or strip 48 not only serves to transfer force, but also provides a spring force that urges the pusher, back to its rest position.

As shown in FIG. 1, the stop tab 58 is formed from a bent-up part at the front of the mount portion or plate 46 of sheet metal. The plate is of generally rectangular shape with sides 50, 52, 54, 56. The plate also has a pair of upstanding guide tabs 62, with a portion of the pusher 44, which is the portion between opposite faces 86, lying between the tabs (or closely outside them). The rear portion of the pusher is confined by the tabs to horizontal sliding movement in forward and rearward directions. The pusher or actuator device 44 has a rearwardly-opening recess 92 which receives the lever 48 of the force transfer member 43, and has a pusher rear end 90. The pusher has an upper face 84 with a pair of elongated protrusions that slide under the cover upper wall. The pusher also has a lower face 82 which slides along the upper face 60 of the plate 46 of the force transfer member. By forming the tabs 62, 58 and opening in the same part that forms the lever 48, the pusher is accurately guided in movement. Vertical edges 114 of the cover engage the front portion of the pusher to act with the guide tabs 62 to guide the pusher in movement.

The lower housing portion 12 is molded of plastic material, with sides 14, 16 and a bottom 18. The inner and outer contacts 30, 34 are molded in place. The lower housing portion has a ledge for supporting a side of the tripping member opposite the outer contact 34, with the front and rear of the tripping member being unsupported. The inner contact has a tail 28 for solder mounting to a circuit board trace, while the outer contact 34 has a similar tail 32. The tripping member 36 is laid in place in the recess 22 of the lower housing portion, and the sealing film 42 is laid on the upper surface 20 of the lower housing, and may be sealed by adhesive thereto. The pusher 44 is laid on the force transfer member 43 and inserted into the cover 102. With the cover or upper housing part 102 lying on the lower housing part 12, tabs 118 of the upper housing part are bent into recesses 120 of the lower housing part to lock the housing parts together. The upper housing part has front and rear walls 108 and opposite side walls 106 which surround much of the actuator arrangement 41. The cover also has tabs 116 that engage the upper face 60 of the plate 46 of the force transfer member to hold it substantially against the lower housing upper face 20 (through the sealing film 42). The upper housing part also has a lower edge 112 and tab lower edges 122.

The switch shown in FIG. 2, has an overall height of about 1.7 mm, a width in the forward-rearward direction F, R of about 3 mm, and a length of about 5 mm. The tripping member has a width of about 1.3 mm. The particular switch was constructed for sensing the full insertion of a smart card into a slot, with snapping of the tripping member being transmitted through the pusher 44 to the smart card, to enable the person pushing in the smart card to sense switch closing, indicating full card insertion. The small size of the switch, with its upper wall 104 having dimensions of less than one square centimeter, makes it important that there be a minimum number of reliable and easily constructed parts. The use of a piece of sheet metal to transmit force from the pusher to the tripping member, and to provide a spring that urges the pusher back towards its rest position, facilitates such construction. The strip of sheet metal of the force transfer member also serves to convert horizontal force to downward force, so the periphery of the tripping member can lie in a largely horizontal plane., which minimizes the height of the switch.

While terms such as "upper", "lower", "horizontal", etc. have been used to aid in the description of the invention as illustrated, by describing the relative orientation of the parts, it should be understood that the switch can be used in any orientation with respect to the Earth.

Thus, the invention provides a miniature switch which is reliable, can be readily handled, and can be constructed at moderate cost. The switch includes a sheet metal force transfer member with a strip or lever having a front end bent into the form of a front loop, and with a depressing part located at the bottom of the loop to depress a snap dome or tripping member. The forward loop has inclined surface locations engaging a ramp on an actuator device or pusher. When the pusher is moved horizontally rearward, it causes the front loop to be deflected downwardly, thereby moving the depressing part downwardly to snap down the tripping member. When the pusher is no longer pressed rearwardly, the bent lever acts as a spring that moves the front loop up again, and which moves the pusher forwardly to a rest position. The strip has a rear loop which provides high resilience in bending. The piece of sheet metal that forms the lever, also forms a plate with an upstanding stop tab that limits forward and rearward movement of the pusher, and that forms an upper surface on which the pusher slides forward and rearward. The plate also can form a pair of upstanding guide tabs that guide the pusher in forward and rearward movement.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An electrical switch that includes a housing, outer and inner contacts mounted on said housing, a tripping member with a peripheral tripping portion engaging said outer contact and with a middle tripping portion lying over or under said inner contact and vertically downwardly depressible against or away from said inner contact, and an actuator arrangement for depressing said middle tripping portion, wherein:

said actuator arrangement comprises a piece of resilient sheet metal having a mount portion substantially fixed with respect to said housing and a resilient lever with an inner portion extending from said mount portion and an outer portion forming a depressing part lying over said middle tripping portion, said lever being bendable to move down said depressing part;

said actuator arrangement also comprises a pusher which is movable from a rest position toward a tripping position, said pusher being movable horizontally from said rest position against said lever to bend said lever and cause said depressing part to move primarily downward toward said middle tripping portion to depress said middle tripping part.

2. An electrical switch that includes a housing, outer and inner contacts mounted on said housing, a tripping member with a peripheral tripping portion engaging said outer contact and with a middle tripping portion lying over said inner contact and vertically depressible to move down against or away from said inner contact, and an actuator arrangement for depressing said middle tripping portion wherein:

said actuator arrangement includes a force transfer member with a depressing part, said force transfer member being mounted on said housing so said depressing part can move primarily down toward said tripping member middle portion and up away therefrom;

said actuator arrangement includes a pusher that is movable in primarily horizontal forward and rearward directions, said pusher having an inclined surface forming a ramp which moves in a path against said transfer member to depress said depressing part thereof to move said depressing part down toward said tripping member, when said ramp moves rearwardly.

3. The switch described in claim 2 wherein:

said housing includes an upper housing part with a downwardly-opening recess and a lower housing part with an upwardly opening recess, said contacts and said tripping member lying in said upwardly-opening recess;

said actuator includes a piece of sheet metal lying above said tripping member and having a rear end, said piece of sheet metal including a strip extending from said plate, said strip forming an upwardly-extending rear loop extending from said plate rear end and lying in said downwardly-opening recess, and a front loop spaced forwardly from said inner loop, said front loop having a lower part forming said depressing part;

said forward loop lying in the path of said ramp when it moves rearwardly.

4. The switch described in claim 3 wherein:

said plate lies in a largely horizontal plane and is trapped between said upper and lower housing parts, and said plate has an opening lying forward of said rear loop;

said depressing part lies substantially in said opening.

5. The switch described in claim 2 wherein:

said housing includes an upper housing part with a downwardly-opening recess and a lower housing part with an upwardly opening recess, said contacts and said tripping member lying in said upwardly-opening recess;

said tripping member has a substantially rectangular periphery and said upwardly-opening recess is substantially rectangular to closely receive said periphery of said tripping member, said outer contact lying at a first side of said recess to support a first side of said tripping member periphery, and said recess having a second side with a raised surface, or ledge, that supports a second side of said tripping member periphery.

6. An electrical switch that includes a housing, outer and inner contacts mounted on said housing, a tripping member with a peripheral tripping portion engaging said outer contact and with a middle tripping portion lying over said inner contact and downwardly depressible against said inner contact, and an actuator arrangement for depressing said middle tripping portion, wherein:

said actuator arrangement comprises a piece of resilient sheet metal having a mount portion substantially fixed with respect to said housing and a resilient lever with an inner loop (70) extending from said mount portion and an outer loop (76) spaced from said inner loop and forming a depressing part (78) lying over said middle tripping portion and an intermediate portion (74) extending between said loops, said lever being bendable to move down said depressing part;

said actuator arrangement also comprises a pusher which is movable from a rest position toward a tripping position, said pusher being movable from said rest position against said lever to bend said lever by bending of said inner loop and cause said depressing part to move largely downward toward said middle tripping portion to depress said middle tripping part, with the resilience of said lever urging said pusher back toward said rest position.

7. An electrical switch that includes a housing, outer and inner contacts mounted on said housing, a tripping member with a peripheral tripping portion engaging said outer contact and with a middle tripping portion lying over said inner contact and downwardly depressible against said inner contact, and an actuator arrangement for depressing said middle tripping portion, wherein:

said actuator arrangement comprises a piece of resilient sheet metal having a mount portion substantially fixed with respect to said housing and a resilient lever with an inner portion extending from said mount portion and an outer portion in the form of an outer loop that lies forward of said inner portion and that forms a depressing part lying over said middle tripping portion, said lever being bendable to move down said depressing part;

said actuator arrangement also comprises a pusher which is movable from a rest position toward a tripping position, said pusher being movable from said rest position against said lever to bend said lever and cause said depressing part to move largely downward toward said middle tripping portion to depress said middle tripping part, with the resilience of said lever urging said pusher back toward said rest position;

said pusher is slidably mounted in forward and rearward directions with respect to said housing, and said pusher has an inclined surface forming a ramp positioned to move rearwardly over said outer loop and depress it as said actuator device slides rearwardly.

8. An electrical switch that includes a housing, outer and inner contacts mounted on said housing, a tripping member with a peripheral tripping portion engaging said outer contact and with a middle tripping portion lying over said inner contact and downwardly depressible against said inner contact, and an actuator arrangement for depressing said middle tripping portion, wherein:

said actuator arrangement comprises a piece of resilient sheet metal having a mount portion substantially fixed with respect to said housing and a resilient lever with an inner portion extending from said mount portion and an outer portion forming a depressing part lying over said middle tripping portion, said lever being bendable to move down said depressing part;

said actuator arrangement also comprises a pusher which is movable from a rest position toward a tripping position, said pusher being movable from said rest position against said lever to bend said lever and cause said depressing part to move largely downward toward said middle tripping portion to depress said middle tripping part, with the resilience of said lever urging said pusher back toward said rest position;

said mount includes a plate lying in a largely horizontal plane and a pair of upstanding guide tabs extending up from said plate, and said pusher has a portion confined by said guide tabs to horizontal sliding movement.

9. The switch described in claim 8 wherein:

said mount includes a stop tab extending up from said plate and said pusher has a part in line with said stop tab, with said stop tab limiting the extent of said horizontal sliding movement of said pusher.

10. An electrical switch that includes a housing, outer and inner contacts mounted on said housing, a tripping member with a peripheral tripping portion engaging said outer contact and with a middle tripping portion lying over said inner contact and downwardly depressible against said inner contact, and an actuator arrangement for depressing said middle tripping portion, wherein:

said actuator arrangement comprises a piece of resilient sheet metal having a mount portion substantially fixed with respect to said housing and a resilient lever with an inner portion extending from said mount portion and an outer portion forming a depressing part lying over said middle tripping portion, said lever being bendable to move down said depressing part;

said actuator arrangement also comprises a pusher which is movable from a rest position toward a tripping position, said pusher being movable from said rest position against said lever to bend said lever and cause said depressing part to move largely downward toward said middle tripping portion to depress said middle tripping part, with the resilience of said lever urging said pusher back toward said rest position;

said mount includes a plate lying in a largely horizontal plane, with said plate having a hole positioned to pass said depressing part.

11. An electrical switch that includes a housing, outer and inner contacts mounted on said housing, a tripping member with a peripheral tripping portion engaging said outer contact and with a middle tripping portion lying over said inner contact and downwardly depressible against said inner contact, and an actuator arrangement for depressing said middle tripping portion, wherein:

said actuator arrangement comprises a piece of resilient sheet metal having a mount portion substantially fixed with respect to said housing and a resilient lever with an inner portion extending from said mount portion and an outer portion forming a depressing part lying over said middle tripping portion, said lever being bendable to move down said depressing part;

said actuator arrangement also comprises a pusher which is movable from a rest position toward a tripping position, said pusher being movable from said rest position against said lever to bend said lever and cause said depressing part to move largely downward toward said middle tripping portion to depress said middle tripping portion, with the resilience of said lever urging said pusher back toward said rest position;

said mount includes a plate lying in a largely horizontal plane and having an upper face; and said pusher is horizontally slidable on said upper face of said plate.

* * * * *